United States Patent [19]

Cunningham

[11] 4,063,502

[45] Dec. 20, 1977

[54] SQUEEGEE AND FLOOD-BAR DRIVE WITH SCREEN LIFT

[76] Inventor: Leroy G. Cunningham, 1515 S. 118 E. Ave., Tulsa, Okla. 74128

[21] Appl. No.: 632,457

[22] Filed: Nov. 17, 1975

[51] Int. Cl.[2] ..... B41F 15/08; B41F 15/42

[52] U.S. Cl. ..... 101/123; 101/128.1

[58] Field of Search ..... 101/123, 124, 126, 127.1, 101/128.1, 114, 115; 118/213, 301, 406

[56] References Cited

U.S. PATENT DOCUMENTS

| | | | |
|---|---|---|---|
| 1,443,316 | 1/1923 | Evans | 101/126 |
| 1,545,926 | 7/1925 | Rand | 101/126 |
| 2,547,817 | 4/1951 | Frank | 101/123 |
| 2,846,946 | 8/1958 | Schwarzberger | 101/115 |
| 3,143,961 | 8/1964 | Jaffa et al. | 101/123 |
| 3,477,366 | 11/1969 | Forslund | 101/123 |
| 3,483,819 | 12/1969 | Hughes, Jr. | 101/123 |
| 3,885,493 | 5/1975 | Jaffa | 101/123 |

*Primary Examiner*—R.E. Suter

*Attorney, Agent, or Firm*—Head, Johnson & Chafin

[57] ABSTRACT

Silk screen printing apparatus comprising the usual silk screen frame hingedly secured to suitable support base, and having an inking-squeegee reciprocally movable with respect to the silk screen frame for alternately applying ink to the silk screen and squeegeeing the ink onto the media being printed during the printing operation; a flood bar maintained in a position of close proximity to the surface of the silk screen in one direction of movement of the inking-squeegee for applying ink to the silk screen; a squeegee maintained in a position of close proximity to the surface of the silk screen during movement of the inking-squeegee in an opposite direction for pressing the ink through the silk screen during a printing operation; pin devices carried by the inking-squeegee for automatically pivoting the silk screen frame about the hinged connection in one direction of movement of the inking-squeegee for elevating the silk screen to facilitate removal of the printed media and isertion of the next succeeding media to be printed; an endless chain operably connected to the inking-squeegee to provide said reciprocal movement therefor.

6 Claims, 8 Drawing Figures

SQUEEGEE AND FLOOD-BAR DRIVE WITH SCREEN LIFT

BACKGROUND OF THE INVENTION

1. Field of the Invention

This invention relates to improvements in silk screen printing apparatus and more particularly, but not by way of limitation, to a novel silk screen printing apparatus wherein inking of the silk screen, squeegeeing of the ink with respect to the silk screen, and raising of the silk screen frame for access to the printed media is accomplished automatically.

2. Description of the Prior Art

In a silk screen printing operation with the usual apparatus available today, the usual silk screen frame is provided with means for flooding or applying ink to one side of the properly prepared silk screen by moving therealong in one direction. Squeegee means is also provided for moving along the inked surface of the silk screen for forcing ink through only those portions of the silk screen corresponding to the desired printed matter to be impressed on the printing media, such as paper, or the like, thus achieving a printing operation. Subsequent to the printing of the media, the silk screen frame is normally manually elevated from the printed media in order to permit removal of the printed material and insertion of the next succeeding item to be processed. The operation is repeated until the entire printing operation has been completed.

SUMMARY OF THE INVENTION

The present invention contemplates a novel silk screen printing apparatus which is particularly designed and constructed for facilitating the silk screen printing operation by providing for an improved inking and squeegeeing means, and for automatically elevating the silk screen frame simultaneously with the application of the ink to the silk screen whereby the overall printing operation may be accomplished more easily and quickly.

The usual silk screen frame is hingedly secured to a suitable support base for pivotaing between a lower printing position and a raised position for access to the printed media and inserting of the next succeeding item to be printed. Inking-squeegeeing means is movably secured to the support base member for movement to and from or reciprocally with respect to the silk screen frame. Chain drive means is operably connected with the inking-squeegeeing means whereby ink is applied to one surface of the silk screen in one direction of movement of the means and the applied ink is squeegeed through the silk screen in the usual manner for a printing operation in a opposite direction of movement of the means. Pin means cooperates between the silk screen frame means and the inking-squeegee means for automatically raising the silk screen during the application of the ink to the silk screen, thus greatly increasing the overall speed and efficiency of the printing operation. The novel silk screen printing apparatus is simple and efficient in operation and economical and durable in construction.

DESCRIPTION OF THE PREFERRED EMBODIMENTS

Figure 1:
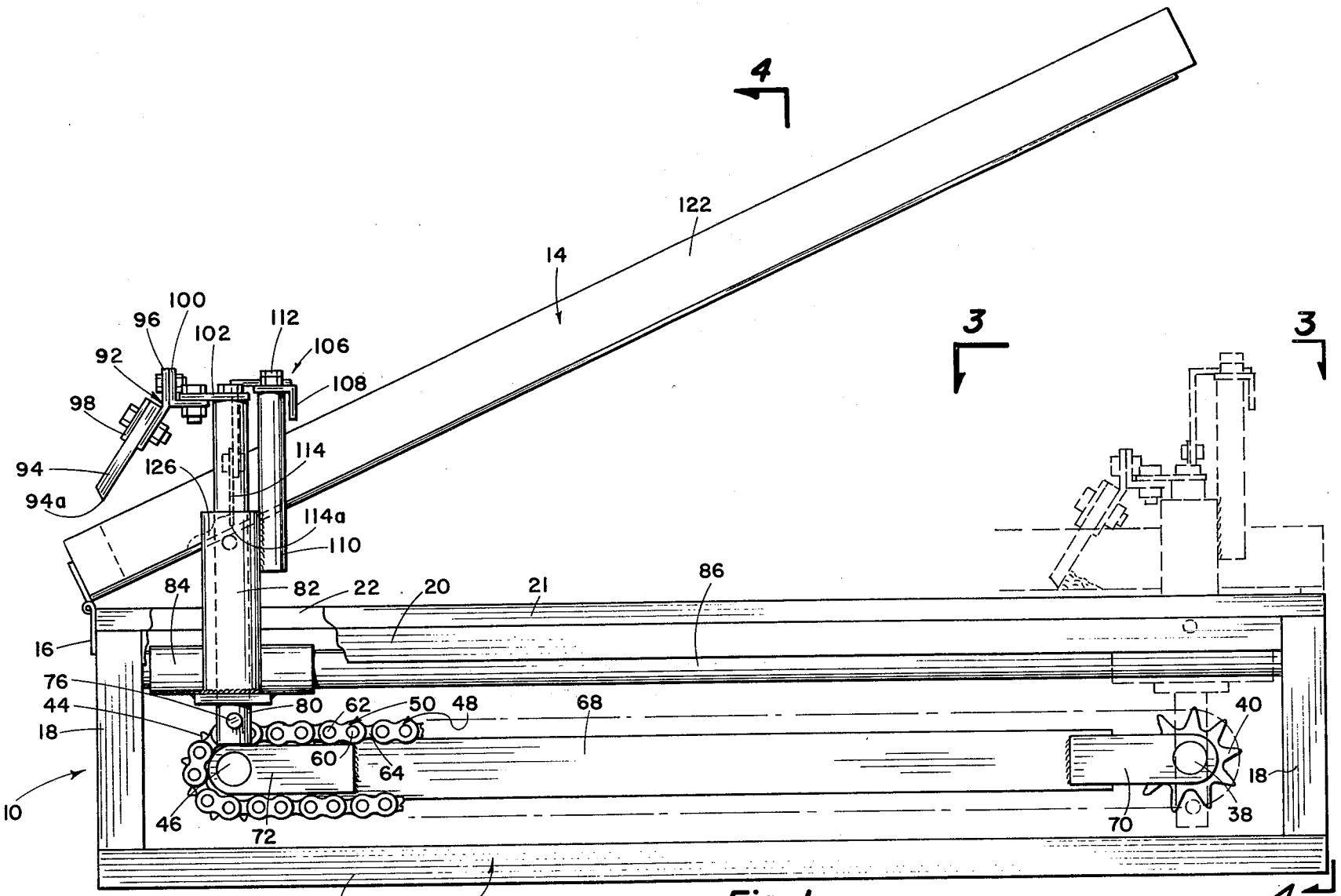
FIG. 1 is a side elevational view of a silk screen printing apparatus embodying the invention and depicting the silk screen frame in a raised position in solid lines and in a lowered position in broken lines.

Referring to the drawings in detail, reference character 10 generally indicates a silk screen printing apparatus comprising a suitable support base 12 having a silk screen frame 14 hingedly secured thereto in any suitable manner, such as a hinge member 16 whereby the frame member 14 may be moved to alternate positions of raised, as shown in solid lines in FIG. 1, and lowered, as shown in broken lines in FIG. 1, and as will be hereinafter set forth in detail. The base 12 may be of any desired constructions and, as shown herein, comprises a lower substantially rectangular open frame structure 16 having upright corner posts 18 secured at each corner thereof for supporting an upper open frame structure 20 in spaced relation to the lower frame 16, thus providing a substantially open, box-type structure.

Figure 5:
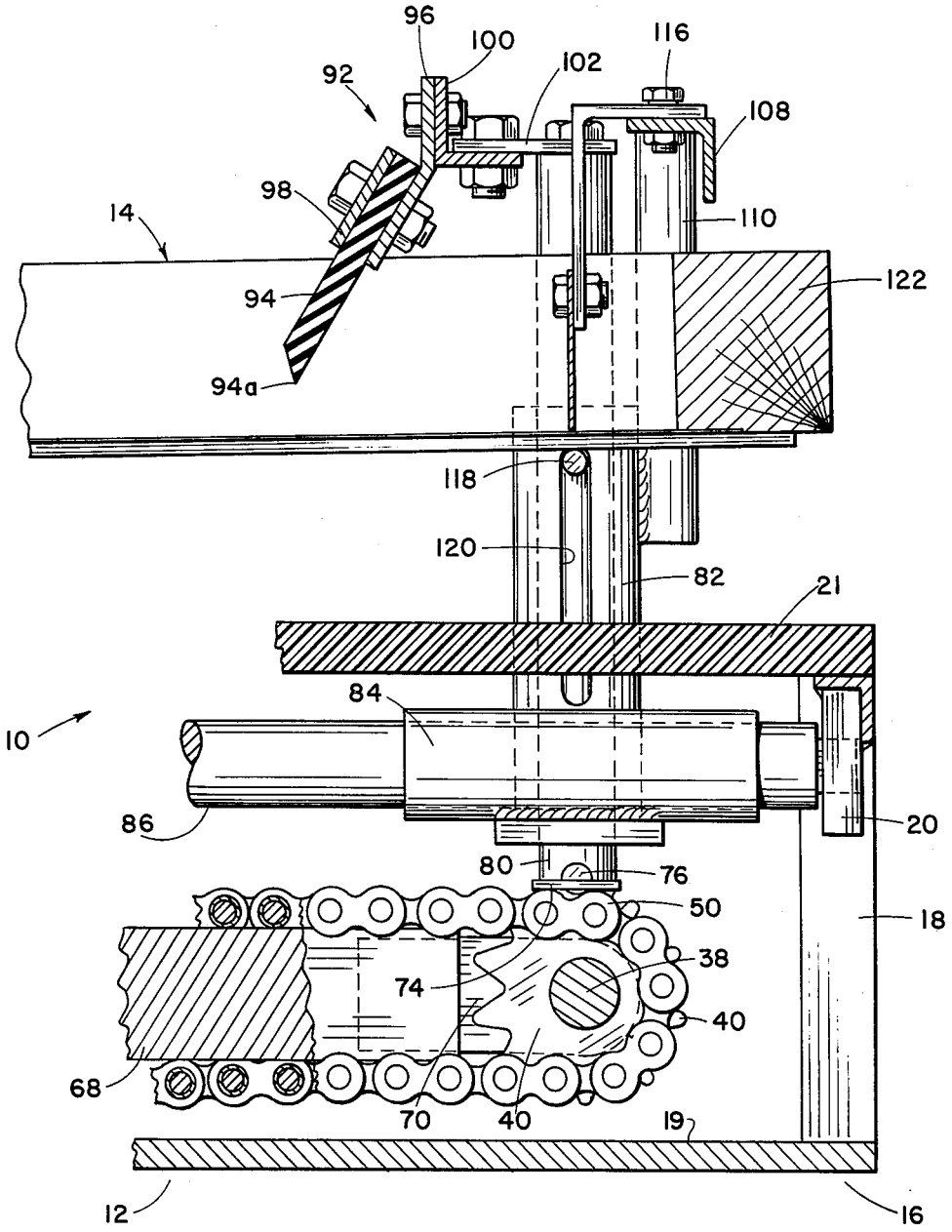
FIG. 5 is a sectional view taken on line 5—5 of FIG. 3.

A bottom plate 19 (FIG. 5) may be supported by the frame 16, if desired. A substantially flat printing plate 21 is suitable supported by the upper frame 20 and is provided with substantially aligned, mutually parallel, elongated slots 22 and 24 extending longitudinally along the opposite sides thereof, as particularly shown in FIG. 2. In addition, the slot 22 is provided with a pair of spaced inwardly directed off-set recesses 26 and 28 in substantial alignment with a pair of complementary off-set recesses 30 and 32, respectively, provided in the slot 24 for a purpose as will be hereinafter set forth.

Figure 4:
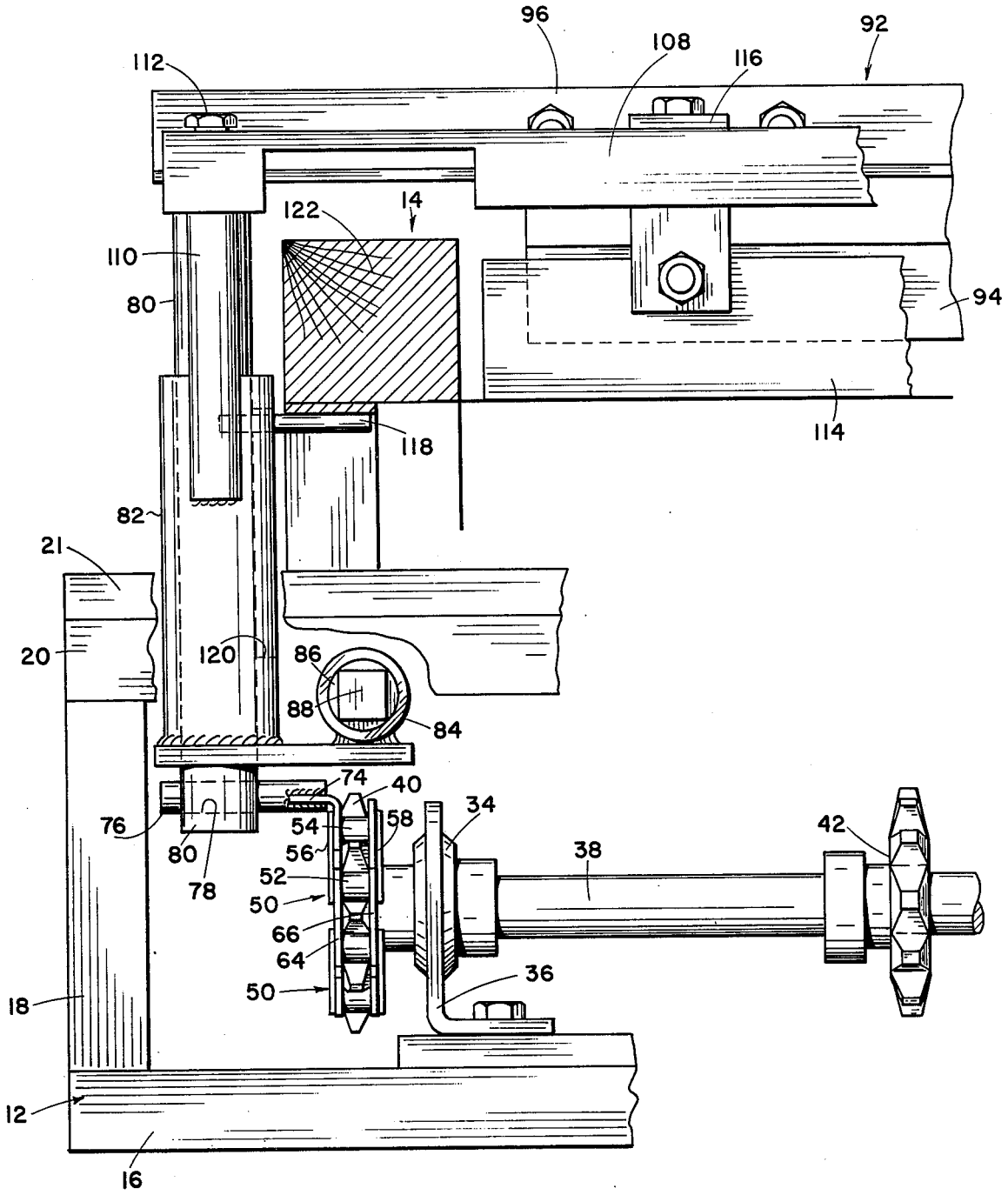
FIG. 4 is a view taken on line 4—4 of FIG. 1.

A pair of suitable spaced journals or bearing members 34 (only one of which is shown in FIG. 4) are supported by the base 12 in any well-known manner, such as by a pair of bracket members 36 (only one of which is shown) bolted or otherwise secured to the frame 16, for receiving the opposite ends of a rotatable axle or drive shaft 38 therethrough. A drive sprocket 40 is secured to one end of the shaft 38 for rotation simultaneously therewith, and a substantially identical drive sprocket (not shown) is similarly secured to the opposite end of the shaft 38. The sprockets 40 are disposed on opposite sides of the base 12 and are each preferably in substantial alignment with the respective slots 22 and 24. A suitable drive means, such as an electric motor (not shown) may be mounted on the base 12 in any well-known manner and operably connected with the axis or drive shaft 38 through suitable gearing, or the like, generally indicated at 42 in FIG. 4, for rotating the shaft 38 about its own longitudinal axis for transmitting simultaneous and synchronized rotation to the drive sprockets 40.

A freely rotatable or idler sprocket 44 is spaced from the drive sprocket 40 in substantially planar alignment therewith as particularly shown in FIG. 1 and is rotatably journalled on a shaft 46 which is supported on the base 12 in any suitable manner (not shown). A substantially identical idler sprocket (not shown) is similarly journalled in substantially axial alignment with the sprocket 44 and in substantial planar alignment with the second drive sprocket 40, which is not shown in the drawings. Endless chain 48 extends between and around the sprockets 40 and 44, as shown in FIG. 1, and a substantially identical chain (not shown) similarly extends between and around the second drive sprocket 40 and second idler sprocket 44, neither of which are shown in the drawings. The two chains 48 are preferably in substantial alignment with the respective slots 22 and 24 for a purpose as will hereinafter be set forth.

The chains 48 are preferably of the well-known roller chain type wherein each link 50 comprises a pair of spaced transversely disposed rollers or rotatable sleeves 52 and 54 (FIG. 4) interposed between spaced link plates 56 and 58 which are secured together by pins 60 and 62 extending longitudinally through the sleeves 52 and 54. The adjacent or succeeding links 50 of the chain 48 are connected together by a pair of spaced plate members 64 and 66 having the opposite ends thereof journalled on the pin 60 of one link 50 and the pin 52 of the adjacent or succeeding link 50.

An elongated bar 68 is interposed between the sprockets 40 and 44 in substantial alignment therewith, and each end of the bar 68 is bifurcated, as shown at 70 and 72 whereby the bifurcated end 70 receives the sprocket 40 therein and is secured to the shaft 38 in any suitable manner, and the bifurcated end 72 receives the sprocket 44 therein and is suitably secured to the pin 46. The rollers or sleeves 52 and 54 of the portion of the chain 48 disposed adjacent the bar 68 roll along the opposite edges thereof during operation of the apparatus 10, and the plate members 56 and 58 of the chain portion disposed adjacent the bifurcated ends 70 and 72 ride along the outer edges thereof during operation of the apparatus 10, as will be hereinafter set forth. Of course, a bar 68 having bifurcated ends 70 and 72 is similarly provided for the second drive sprocket 40 and second idler sprocket 44, none of which are shown in the drawings.

It is to be understood that whereas the chains 48 are substantially identical and are identically arranged, only one such arrangement will be set forth in detail herein.

Figure 6:
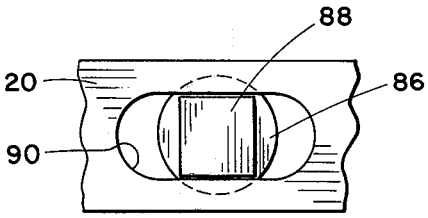
FIG. 6 is a view taken on line 6—6 of FIG. 3.

One link 50 of the chain 48 is provided with an outwardly extending connector member 74 (FIG. 4) secured to a pin 76 which extends through a transverse bore 78 provided in the proximity of one end of a rod 80. The pin 76 is rotatably disposed within the bore 78 for a purpose as will be hereinafter set forth. The rod 80 extends longitudinally through a sleeve 82 and is freely reciprocal with respect thereto. The sleeve 82 extends through the slot 22 provided in the plate 21 and is slidably disposed therein. The sleeve 82 is rigidly secured to the outer periphery of a perpendicularly arranged sleeve 84 which is slidably mounted on a rod 86 having the opposite ends thereof supported by the base 12. The opposite ends of the rod 86 are preferably each provided with a reduced support portion 88 (FIG. 6) slidably disposed in an elongated slot 90 provided in the base 12, such as in the upper frame 20 thereof. Thus, during operation of the apparatus 10, any slack due to dimensional variances in the construction thereof will be compensated for by permitting a floating action for the rod 86, as will be hereinafter set forth.

As the drive sprockets 40 are rotated about their respective axes, the chain 48 will move continuously between and around the sprockets 40 and 44, and the rods 80 will be moved simultaneously therewith, carrying the sleeves 82 therewith, and sliding the sleeves 84 along the rods 86. When the link 50 to which the rod 80 is secured is moving along the upper portion of the chain passageway, the rod 80 will be disposed in its uppermost position within the sleeve 82, as shown in solid lines in FIG. 1. When the link 50 to which the rod 80 is connected is moving along the lower portion of the chain passageway, the rod 80 will be extended downwardly with respect to the sleeve 82 as shown in broken lines in FIG. 1, all for a purpose as will be hereinafter set forth.

The upper or outermost end of the rod 80 extends beyond the upper limit of the sleeve 82, and a squeegee means 92 is rigidly secured thereto for movement simultaneously therewith. The squeegee means 92 may be of any suitable construction, and as shown herein, comprises a flat elongated flexible squeegee member 94 preferably constructed from rubber or the like, but not limited thereto, and extending transversely across the plate 21 as particularly shown in FIG. 2. The squeegee member 94 is secured to an elongated bracket member 96 by a plate member 98 bolted or otherwise connected therewith. The bracket 96, in turn, is bolted or otherwise secured to an angle member 100, the opposite ends of which are secured to the upper ends of each rod 80 by strap members 102, which may be bolted or otherwise secured to the rods 80 as shown at 104. The squeegee member 94 is thus supported by the rods 80 and extends across a portion of the plate 21 disposed off-set from the axes of the rods 80 as clearly shown in the drawings.

Figure 2:
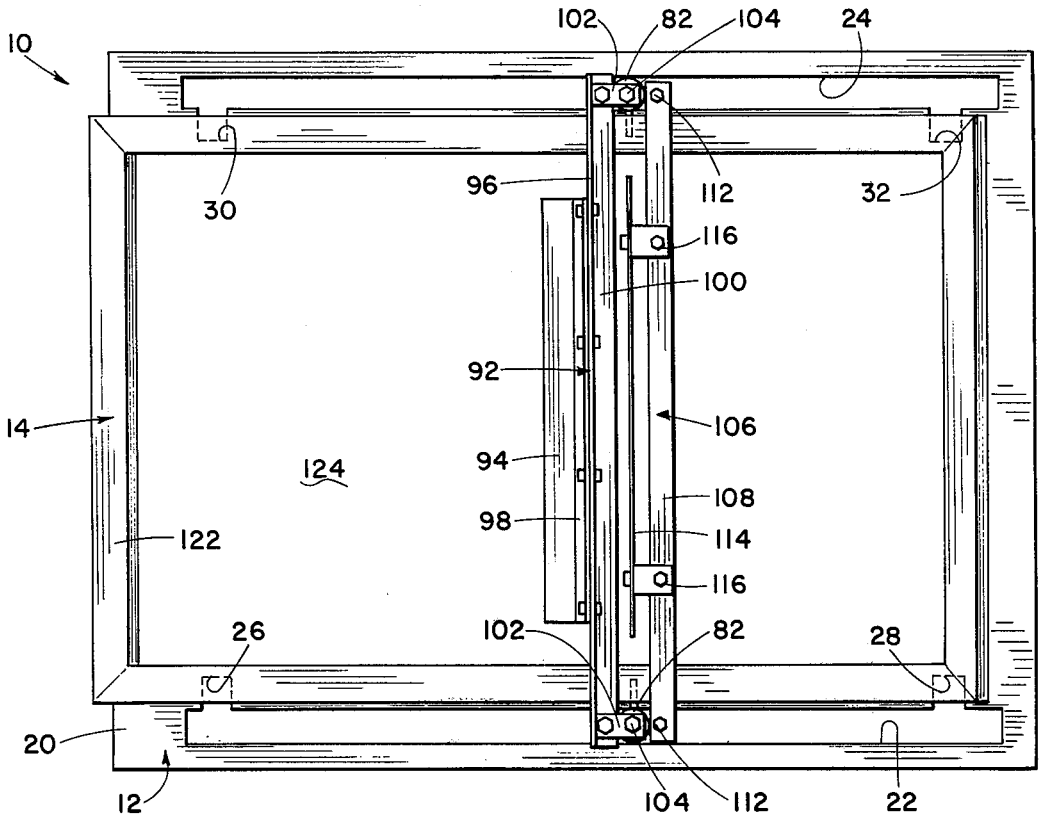
FIG. 2 is a plane view of a silk screen printing apparatus embodying the invention.

Flood bar means generally indicated at 106 is carried by the sleeves 82 and comprises an elongated angle member 108 extending between the sleeves 82 and having the opposite ends thereof loosely secured to stub posts 110 by means of a suitable threaded bolt 112, or the like. The posts 110 are, in turn, rigidly secured to the sleeves 82 in any suitable manner, such as by welding, or the like. A flood bar member 114 of the usual or well-known type is rigidly secured to the cross member 108 by suitable mounting brackets 116 for movement simultaneously therewith, as will be hereinafter set forth, and extends transversely across the plate 21 as shown in FIG. 2.

A pin member 118 is rigidly secured to the rod 80 in any well-known manner and extends radially outwardly therefrom through an elongated, open-ended slot 120 (FIG. 4) provided in the sidewall of the sleeve 82 and extending longitudinally therein. The pin 118 is slidable within the slot 120 and is reciprocated therein as the rod 80 reciprocates within the sleeves 82 for a purpose as will be hereinafter set forth.

The silk screen frame 14 may be of any suitable well-known type and, as shown herein, comprises a rectangular peripheral frame 122 having the silk screen 124 disposed therein. The squeegee member 94 and the flood bar 114 are disposed within the confines of the outer peripheral frame 122 as clearly shown in FIG. 2, and move to and fro in a longitudinal direction across or along the silk screen for performing a silk screen printing operation in much the same manner as is well known with the use of present-day silk screen printing devices.

As hereinbefore set forth, during operation of the apparatus 10, the rollers 52 and 54 of the links 50 roll along the opposite edges of the bar 68 as the chains 48 move between and around the sprockets 40 and 44. When the links 50 are in the proximity of the sprockets 40 and 44, the side plate members 56 and 58 of the links 50 ride on the outer edges of the bifurcated end members 70 and 72.

Figure 7:
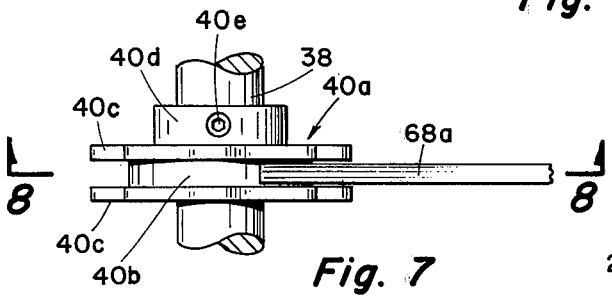
FIG. 7 is a plane view of a modification of a portion of the drive mechanism of the invention.
Figure 8:
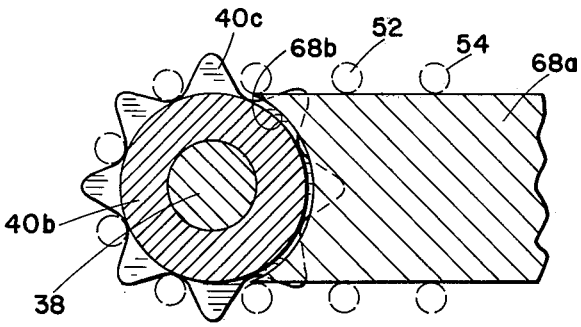
FIG. 8 is a sectional view taken on line 8—8 of FIG. 7.
Figure 3:
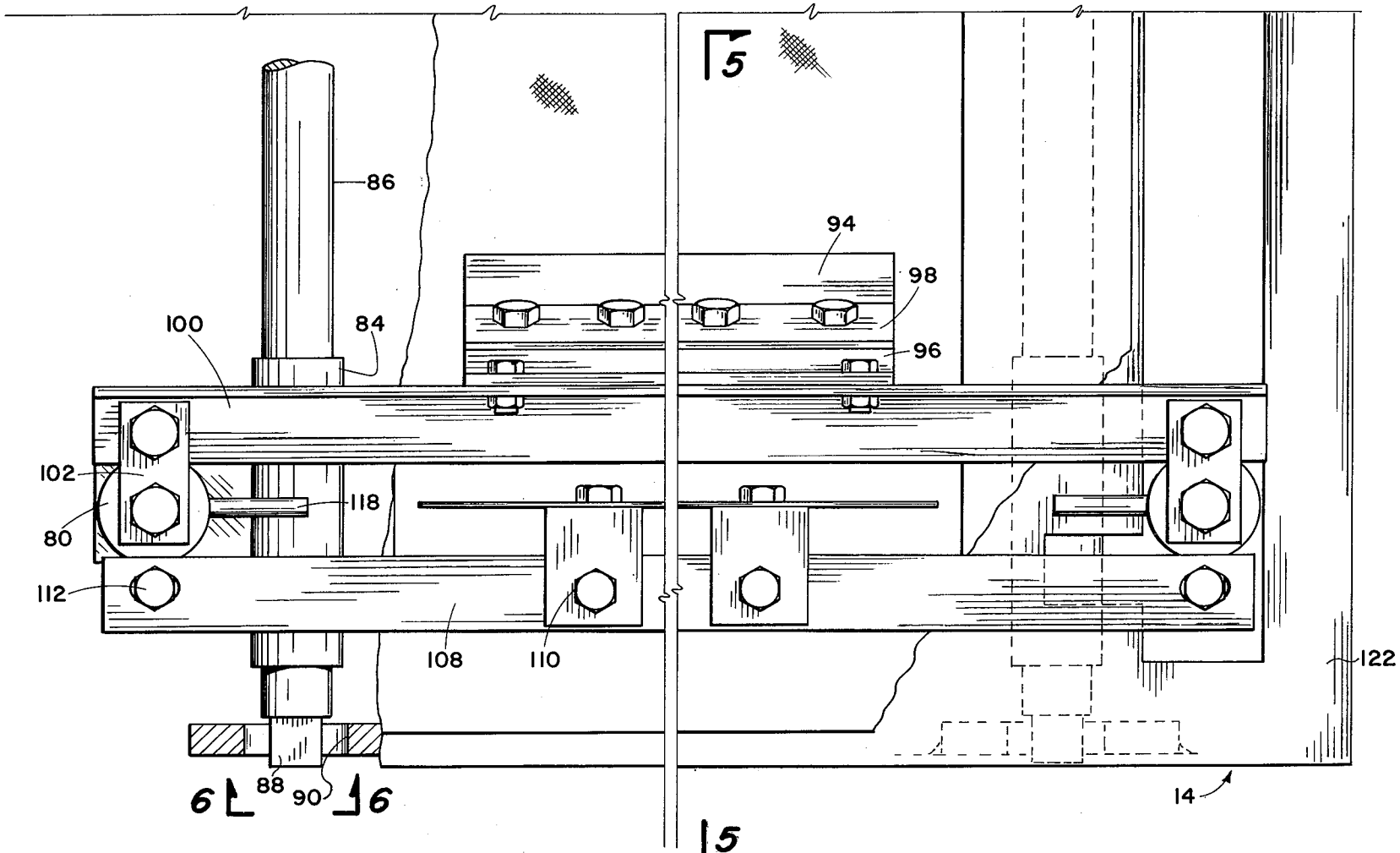
FIG. 3 is a view taken on line 3—3 of FIG. 1.

A modification of the sprocket means is shown in FIGS. 7 and 8 wherein a bar 68*a*, generally similar to the bar 68, is interposed between sprockets 40*a*, only one of which is shown in FIGS. 7 and 8. The sprockets 40*a* comprise a central hub member 40*b* having complementary sprocket wheels 40*c* rigidly secured to each end thereof and receiving the drive shaft 38 therethrough. A collar 40*d* is secured to one of the sprocket wheels 40*c* and oppositely disposed from the central hub 40*b*, and is secured to the shaft 38 by suitable set screw means 40*e* whereby the sprocket assembly 40*a* will be rotated simultaneously therewith. The opposite ends of the bar 68*a* are arcuate, as shown at 68*b* for positioning substantially adjacent the outer periphery of the central hub 40*b* as particularly shown in FIG. 8, thus eliminating the need for the bifurcated members 70 and 72. As the links 50 move between the sprockets 40*a*, the rollers 52 and 54 roll along the outer edges of the bar 68*a*, and are engaged directly by the sprocket wheels 40*c* as the links 50 move around the sprockets 40*a*.

In operation, the silk screen 124 is prepared in the usual manner for producing a desired printing on a suitable printing media, such as papaer or the like (not shown). The apparatus 10 is initially arranged in such a manner that the pin 118 is in engagement with the under surface of the frame 122 in the proximity of the hinge member 16, as shown in solid lines in FIG. 1, thus supporting the silk screen frame means 14 in an elevated angular position with respect to the plate 21. The printing media may then be placed on the plate 21 in the proper position for receiving the printing thereon, all as is well known in the industry. The apparatus 10 may then be operated by actuation of the motor (not shown) for rotating the drive sprockets 40 in unison through the drive shaft 38. As the sprockets 40 rotate, the chains 48 are moved endless between and around the complementary pairs of sprockets 40 and 44, carrying the pin 76 along therewith.

It is to be noted that when the pins 118 are in position against the under surface of the frame 122, the flood bar member 114 is disposed in close proximity of the upper surface of the silk screen 124. When the flood bar 114 moves in one direction along the silk screen 124, as will be hereinafter set forth, ink is swept across the face of the silk screen, as is well known, and accumulates along one side of the flood bar 114, as shown at 126 in FIG. 1.

When the operation of the apparatus 10 is initiated by activation of the motor or other power source (not shown) for driving the sprockets 40 simultaneously and in synchronization through the drive shaft 38. As the sprockets 40 are rotated in a counterclockwise direction, as viewed in FIG. 1, the chains 48 move between and around the sprockets 40 and 44 in a counter-clockwise direction, carrying therewith the pin 76. Assuming that the pins 76 are initially in the left-hand position thereof as viewed in solid lines in FIG. 1, the counterclockwise movement of the chains 48 will move the pins 76 in a generally downward direction around the outer periphery of the sprocket 44 and along the lowermost course of travel for the chains 48, and in a direction toward the sprockets 40. This movement of the pins 76 will cause the rods 80 and sleeves 82 to move simultaneously therewith. Simultaneously, the rods 80 move downwardly in the sleeves 82, and the sleeve 84 slides longitudinally along the rods 86 in the direction toward the sprockets 40. The end support members 88 of the rods 86 will move freely within the respective slots 90 as the sleeves 84 slide along the rods 86 in order to compensate for any dimensional variances in the construction of the apparatus 10 and to preclude any binding between the rod 86 and sleeve 84 during the operation of the apparatus 10.

As the rods 80 move around the sprockets 44 and in the direction toward the sprockets 40, the silk screen frame 14 will be pivoted in a clockwise direction about the hinge 16 since gravity will keep the frame 122 in a supported position against the pins 118. Thus, the silk screen frame 14 will be lowered into a position substantially adjacent the plate 21, or to the position shown in broken lines in FIG. 1. Simultaneously with this movement of the rod 80 toward the sprockets 40, the flood bar member 114 will be moved across the upper surface of the silk screen 124 in the same direction, thus facilitating the lowering of the silk screen frame.

In addition, as the pins 76 move downward around the outer periphery of the sprocket 44 and to the lowermost path or course of travel for the chain 48, the rod 80 will be pulled downwardly through the sleeve 82, pulling the squeegee means 92 downwardly simultaneously therewith until the lower edge 94*a* of the squeegee member 94 is in engagement with the upper surface of the silk screen 124. Continued movement of the pins 76 across the lower course of the chains 48 in a direction toward the sprocket 40 will carry the squeegee member 94 longitudinally along the upper surface of the silk screen 124 for "squeegeeing" the ink through the proper portion of the screen 124 for applying the desired printing on the media (not shown) disposed between the plate 21 and silk screen 124, as is well known.

When the pins 76 reach the sprockets 40 and move around the outer periphery thereof, the rods 80 and squeegee means 92 will be moved upwardly whereby the squeegee member 94 will be removed from engagement with the silk screen 124. It is to be noted, however, that the flood bar 114 remains in a position approximately adjacent the upper surface of the silk screen 124 at all times. The loose connection between the strap 108 and the posts 110 will compensate for dimensional variations between the lowermost end or edge 114*a* of the flood bar 114 and the outer periphery of the pins 118 during operation of the apparatus 10.

As the pins 76 reach the upper limit of the sprockets 40 and move across the uppermost course or pathway of the chains 48, the flood bar means 106 will be moved longitudinally along the upper surface of the silk screen 124 and in a direction away from the sprockets 40, thus flooding the surface of the silk screen with a supply of ink for the next printing operation. Simultaneously with the movement of the flood bar means 106 in a left-hand direction, as viewed in FIG. 1, the pins 118, riding along the lower edges of the frame 122, will cause the silk frame assembly 14 to pivot in a counterclockwise direction about the hinge 16 from the position shown in broken lines in FIG. 1 to the position shown in solid lines therein. Thus, as the silk screen 124 is being inked, access is provided to the previously printed media, which may be removed from the apparatus 10 and replaced with the next succeeding item to be printed.

Of course, continued operation of the apparatus 10 will print substantially any desired number of items in sequence with speed and efficiency.

From the foregoing, it will be apparent that the present invention provides a novel silk screen printing apparatus comprising a support base having a media receiving plate supported thereon and a silk screen frame means pivotally or hingedly secured thereto. Inking-squeegeeing means is carried by the support base for automatic to and from movement across the silk screen means for applying ink to the silk screen in one direction of movement of the inking-squeegeeing means and for squeegeeing the ink through the silk screen in an opposite direction of movement thereof. Simultaneously with the inking of the silk screen, the silk screen assembly is pivoted to an angularly disposed position with respect to the support means to provide access to the previously printed media for removal thereof and insertion of the next succeeding item to be printed.

Whereas the present invention has been described in particular relation to the drawings attached hereto, it should be understood that other and further modifications, apart from those shown or suggested herein may be made within the spirit and scope of this invention.

What is claimed is:

1. Silk screen printing apparatus comprising support base means, frame means hingedly secured to the support base means and pivotally movable between raised and lowered positions with respect thereto, a silk screen carried by said frame means, inking-squeegeeing means movable to and fro with respect to the frame means for applying ink to the silk screen in one direction of movement and squeegeeing ink through said silk screen in an opposite direction of movement, drive means carried by the support base means and operably connected with the inking-squeegeeing means for providing said to and fro movement therefor, and means carried by the inking-squeegeeing means for automatically raising the frame means during the inking of the silk screen and lowering the frame means prior to the squeegeeing of the silk screen and wherein said last-mentioned means comprises pin means rigidly secured to the inking-squeegeeing means and slidably engageable with the frame means for pivoting the frame means about the hinged connection thereof upon one direction of movement of the inking squeegeeing means and pivoting of the frame means about the hinged connection thereof upon an opposite direction of movement of the inking-squeegeeing means.

2. Silk screen printing apparatus as set forth in claim 1 wherein the inking-squeegeeing means comprises an independent flood bar member and squeegeeing member, means connecting the squeegeeing member with the drive means to provide alternate raised and lowered positions of the squeegeeing member with respect to the silk screen carried by the frame means, and means operably connecting the flood bar member with the frame means and silk screen to provide substantially constant contact of the flood bar member with the silk screen.

3. Silk screen printing apparatus comprising support base means, frame means hingedly secured to the support base means and pivotally movable between raised and lowered positions with respect thereto, a silk screen carried by said frame means, inking-squeegeeing means movable to and fro with respect to the frame means for applying ink to the silk screen in one direction of movement and squeegetting ink through said silk screen in an opposite direction of movement, drive means carried by the support base means and operably connected with the inking-squeegeeing means for providing said to and from movement therefor, means carried by the inking-squeegeeing means for automatically raising the frame means during the inking of the silk screen and lowering the frame means prior to the squeegeeing of the silk screen, said inking-squeegeeing means comprising an independent flood bar member and squeegeeing member, means connecting the squeegeeing member with the drive means to provide alternate raised and lowered positions of the squeegeeing member with respect to the silk screen carried by the frame means, and means operably connecting the flood bar member with the frame means and silk screen to provide substantially constant contact of the flood bar member with the silk screen, and wherein the connecting means between the squeegee member and the drive means comprises a pair of spaced mutually parallel simultaneously vertically reciprocal rod members carried by the drive means and the connecting means between the flood bar member and the frame means comprises a pair of spaced mutually parallel pin members connected with the flood bar member and slidably engagable with said frame means and movable to and fro in synchronization by said drive means.

4. Silk screen printing apparatus as set forth in claim 3 wherein the drive means comprises first sprocket means rotatably supported on said support base means to provide drive sprocket means, second sprocket means rotatable supported on said support base means to provide driven sprocket means, chain means extending between and around said drive and driven sprocket means and movable thereby, and means operably connected between the chain means and the vertically reciprocal rod members for actuation of said rod members.

5. Silk screen printing apparatus as set forth in claim 4 and including slide bar means carried by the support base means and disposed in spaced substantially parallel relation to the chain means and drive and driven sprocket means, and means operably connecting said inking connection means with said slide bar means to provide said to and fro movement for said inking member.

6. Silk screen printing apparatus as set forth in claim 5 wherein the drive sprocket means comprises a pair of spaced axially aligned sprocket members carried by a common drive shaft rotatably mounted on said support base means, the driven sprocket means comprises a pair of spaced axially aligned sprocket members in substantial planar alignment with a respective drive sprocket member and spaced therefrom, and the chain means comprises a pair of endless chains extending around and between the associated pairs of drive and driven sprockets whereby each vertically reciprocal rod member is maintained in synchronization with the other rod member.

* * * * *